US005152371A

United States Patent [19]

Wyse

[11] Patent Number: 5,152,371

[45] Date of Patent: Oct. 6, 1992

[54] LIGHTWEIGHT SCAFFOLDING

[76] Inventor: Steven J. Wyse, 595 E. Lugbill Rd., Archbold, Ohio 43502

[21] Appl. No.: 784,879

[22] Filed: Oct. 30, 1991

[51] Int. Cl.[5] ..... E04G 1/00

[52] U.S. Cl. ..... 182/178; 182/119

[58] Field of Search ..... 182/178, 179, 119; 52/638, 730, 761, 731; 403/292, 295, 298

[56] References Cited

U.S. PATENT DOCUMENTS

| | | | |
|---|---|---|---|
| 1,669,611 | 5/1928 | Goldberg | 135/114 |
| 2,990,203 | 6/1961 | Grover | 182/179 |
| 4,111.577 | 9/1978 | Kiyosawa | 403/295 |
| 4,408.431 | 10/1983 | D'Alessio | 182/179 |
| 4,825,976 | 5/1989 | Wyse | 182/222 |
| 4,984,654 | 1/1991 | Anderson | 182/179 |

FOREIGN PATENT DOCUMENTS

| | | | |
|---|---|---|---|
| 48624 | 3/1982 | European Pat. Off. | 182/178 |
| 1940842 | 2/1970 | Fed. Rep. of Germany | 182/178 |

*Primary Examiner*—Alvin C. Chin-Shue

*Attorney, Agent, or Firm*—Allen D. Gutchess, Jr.

[57] ABSTRACT

Lightweight scaffolding is made of aluminum or other lightweight material. The scaffolding includes end frames with vertical and horizontal frame members, the latter having special shapes for greater strength in a vertical direction with rounded top surfaces having ridges to prevent slipping. The horizontal frame members are evenly spaced to provide rungs for workers to climb. The vertical frame members are of generally cylindrical shape with thicker portions on opposite sides, the thicker portions having flat surfaces. One portion provides a full surface to which ends of the horizontal frame members are welded. The other provides a stable surface to which an adjacent end frame can be fastened. Braces can be affixed by bolt and wing nut fasteners so that a brace can be fastened to either side of the vertical frame member. Simplified connecting pins connect vertically stacked end frames. The scaffolding also includes a base to provide added width and stability, to which base vertical frame members are affixed.

19 Claims, 3 Drawing Sheets

LIGHTWEIGHT SCAFFOLDING

This invention relates to a lightweight scaffolding.

The lightweight scaffolding in accordance with the invention is preferably made of aluminum or other lightweight material. The scaffolding can be of modular design, including end frames which can be made in various widths and various heights so as to be adaptable for substantially any application. The end frames include upright or vertical frame members to which horizontal frame members are affixed. The horizontal frame members are spaced along the vertical frame members in a manner to provide evenly spaced rungs for workers to climb. This also allows for standard placement of work platforms throughout the height of the scaffolding. The horizontal frame members are of special shape, termed "ob-round". They include parallel vertical side walls with arcuate or rounded upper and lower walls connecting the ends of the side walls. The upper rounded wall has longitudinally-extending ridges to prevent slipping by workers ascending the scaffolding. The vertical dimension of the horizontal frame members exceeds the horizontal dimension to provide greater strength in a vertical direction where it is needed.

The vertical frame members of the end frames are of cylindrical shape with thicker portions on opposite sides, the thicker portions having longitudinally-extending, outwardly-facing flat surfaces, one being wider than the other. The wider flat surface on one thicker portion provides a full surface to which ends of the horizontal frame members can be securely welded. The flat surface of the opposite thick portion provides a stable surface to which a vertical frame member of an adjacent end frame or accessory can be fastened when the two are placed in adjacent relationship.

The shape of the vertical frame members with the cylindrical configurations and the thicker portions enable the use of less metal, providing the thicker portions for the flat surfaces only where needed. This reduces cost, particularly with aluminum, reduces weight, and offers superior loading capabilities. Further, the circular center passages formed by the vertical frame members enable the members to be employed with standard components, such as standard casters.

Upper portions of the vertical frame members have inwardly-extending tabs to act as stops for connecting pins which connect an end frame to a vertically-stacked one. Above the tabs, the frame members also have holes to receive locking pins for connecting pins, with similar holes being located at lower end portions of the vertical members of the stacked frame for the same purpose. The connecting pins are of uniform cross section substantially throughout their length, without any collars, making them easier to manufacture. The connecting pins are of generally square shape with rounded corners in transverse cross section. This enables them to fit in the vertical frame members more easily with less friction.

The vertical frame members also have diametrically-opposite holes in the thick portions. These serve the purpose of receiving bolts and nuts for affixing braces extending between end frames to the vertical frame members. The braces can be affixed to either the inside or the outside of the vertical frame members at regular intervals. Also, these holes allow a choice of cross braces, arm braces, or folding braces to be used at the users' preferences. Further, the separate bolts can be readily replaced in case of damage, unlike scaffolding having welded studs extending from the frame members, as has heretofore been the practice. Also, this regular hole spacing in the vertical frame members allows for guard railing to always be located at a height above the platform to comply with present codes and regulations.

The scaffolding in accordance with the invention also includes a base to provide additional width for the overall scaffolding to enable stacking height to be greater. The base also is mounted on casters to facilitate portability. The base includes two elongate base members having upright stubs or projections on which the vertical frame members of the end frames are received. Struts also extend up near the stubs and are bolted to the vertical frame members. The base members can also have studs to which cross braces are affixed.

It is, therefore, a principal object of the invention to provide lightweight modular scaffolding having the numerous features and advantages discussed above.

Other objects and advantages of the invention will be apparent from the following detailed description of preferred embodiments thereof, reference being made to the accompanying drawings, in which.

Figure 1:
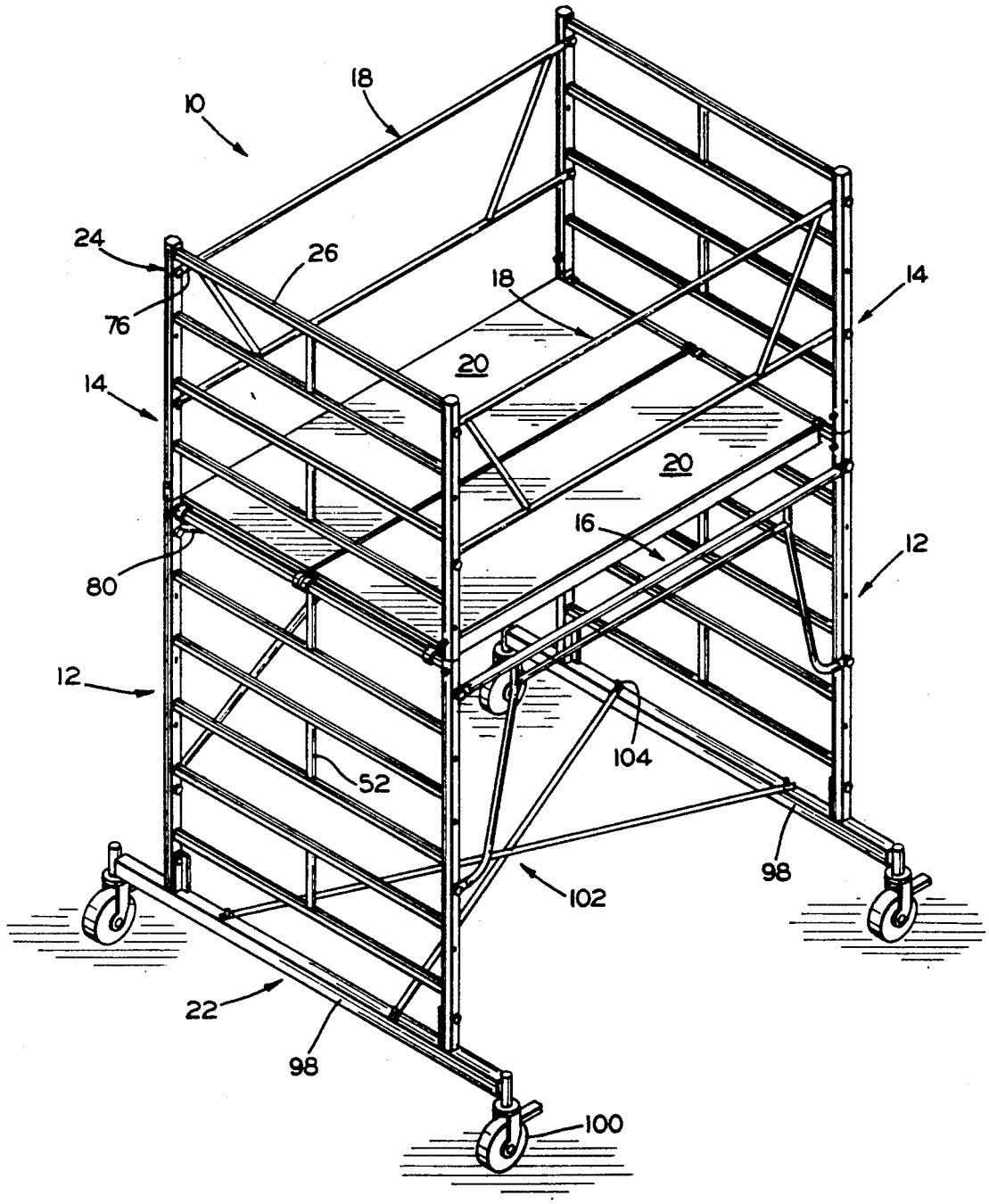
FIG. 1 is a schematic view in perspective of overall scaffolding embodying the invention.

Referring to FIG. 1, overall scaffolding embodying the invention is indicated at 10. It includes end frames 12 and 14 with cross bracing 16 and 18. This bracing is well known in the art. Other designs of bracing can be used, of course. Platforms 20 extend between the end frames 12 and are located in side-by-side relationship. These can be of the type shown in U.S. Pat. No. 4,825,976, issued Aug. 31, 1988, and will not be discussed further. The upper bracing 18 also serves as side panels or rails for workmen on the platforms 20. The scaffolding 10 can further include a base 22 which enables the scaffolding to be moved about and is also preferably wider than the end frames 12 and 14, which enables the end frames to be stacked higher more safely, if desired. The scaffolding also can be used without the base or with separately attached outriggers.

The end frames 12 and 14 are of modular design and can be made in different widths and heights to accommodate various applications. In a preferred form, the end frames are made in a thirty-one inch width to accommodate a single one of the platforms 20 and in a sixty inch width to accommodate two of the platforms 20. The end frames of each width preferably are made in heights of twenty-four inch, forty-eight inch, and seventy-two inch. As shown, the end frame 12 has a sixty inch width with a seventy-two inch height and the end frame 14 has a sixty inch width with a forty-eight inch height. Horizontal frame members for the wider width end frame can extend all the way across it, as shown, or extend across only one half, or can extend about one half the width but located in the center of the end frame.

Figure 2:
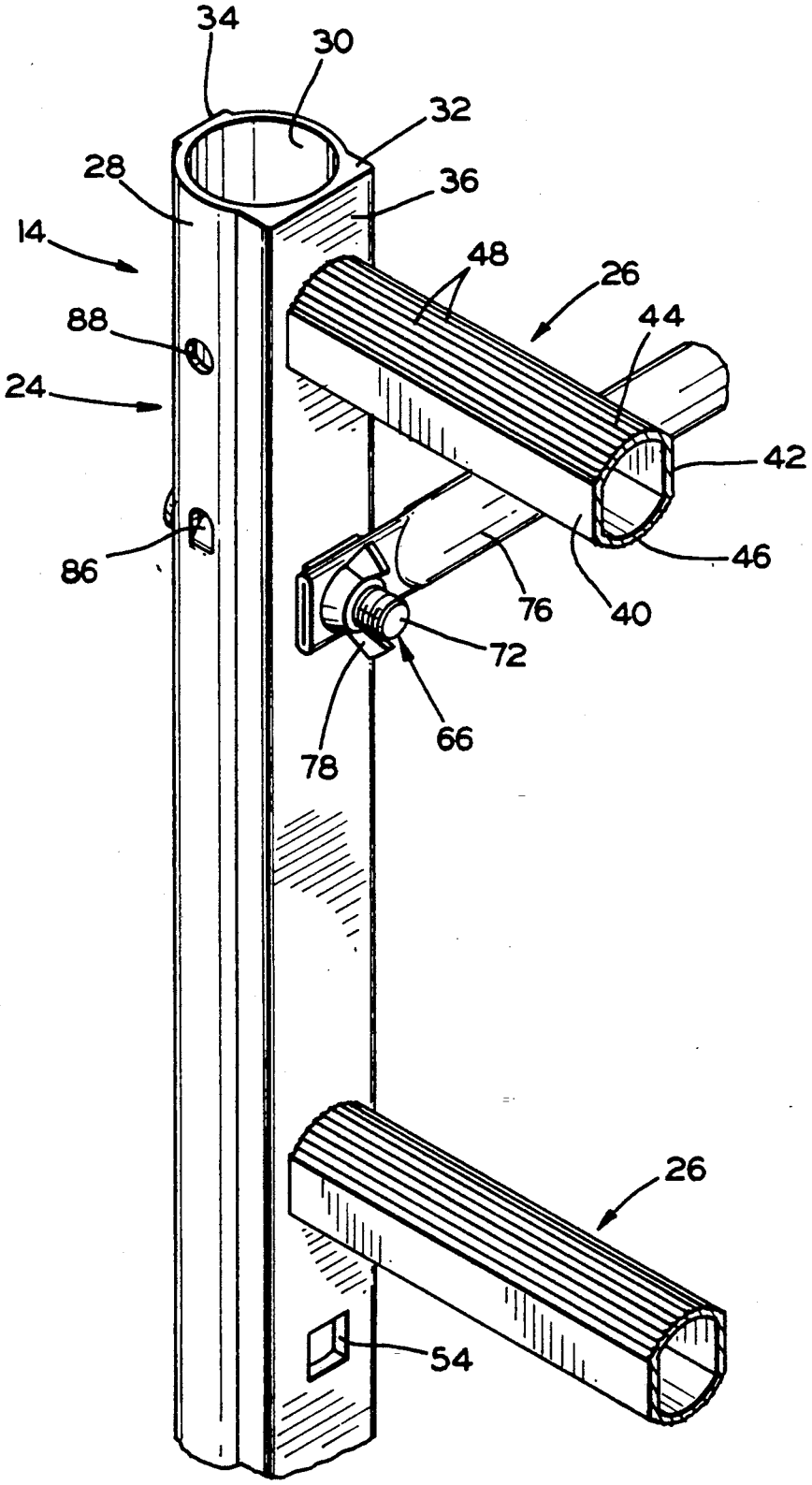
FIG. 2 is an enlarged fragmentary view in perspective of an end frame of the scaffolding and a brace connected thereto.
Figure 7:
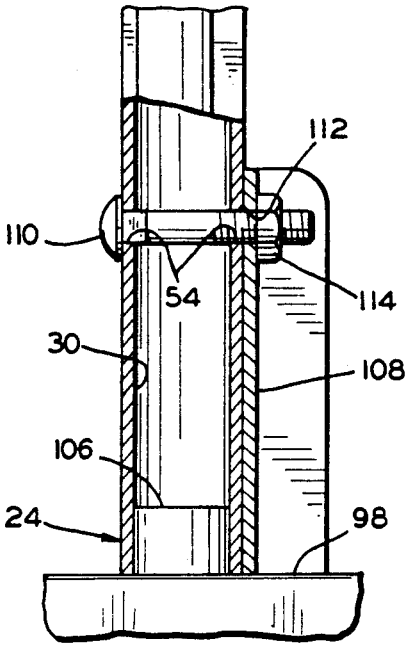
FIG. 7 is a fragmentary view in elevation, with parts broken away, of a portion of a base member shown in FIG. 1.

Referring to FIG. 2, each of the end frames 12 and 14, the end frame 14 being shown, includes an upright or vertical frame member 24 and horizontal frame members 26 affixed thereto. Both the vertical and horizontal frame members preferably are made of extruded aluminum and designed with a minimum cross section to reduce weight and material cost. The vertical frame member 24 has a rounded or cylindrical portion 28 with a cylindrical passage 30 formed therein. The frame member 24 has diagonally opposite thick portions 32 and 34 forming flat surfaces 36 and 38 extending the length of the vertical member 24.

The flat surface 36 is wider in order to provide a full surface for receiving an end of the horizontal frame member 26 which is welded thereto. The frame member 26 is of ob-round shape with parallel side walls 40 and 42 and rounded upper and lower walls 44 and 46, each of which are of partial circular shape. The upper and lower walls have means in the form of ridges 48 and 50 (FIGS. 2 and 3) extending the length thereof to prevent slipping and provide a surer footing for workmen climbing up the end frames to the platforms. The vertical dimension of the horizontal frame members 26 exceeds the horizontal dimension to provide greater stiffness in the vertical direction where it is needed.

The vertical distance between all of the adjacent horizontal frame members 26 is equal, particularly to facilitate ascension and descension of the scaffolding by workmen. The distance between intermediate horizontal frame members of each end frame is twelve inches. The distance between the uppermost horizontal frame member 26 and the upper ends of the vertical frame members 24 is one inch, while the distance between the lowermost horizontal frame member 26 and the lower ends of the vertical frame members 24 is eleven inches. Thus, the distance between the uppermost horizontal frame member of one end frame and the lowermost horizontal frame member of the upper, stacked frame remains twelve inches, the same as the distance between the intermediate horizontal frame members. Short connecting frame members 52 can extend between alternate pairs of horizontal frame members for greater rigidity, as shown in FIG. 1.

Figure 3:
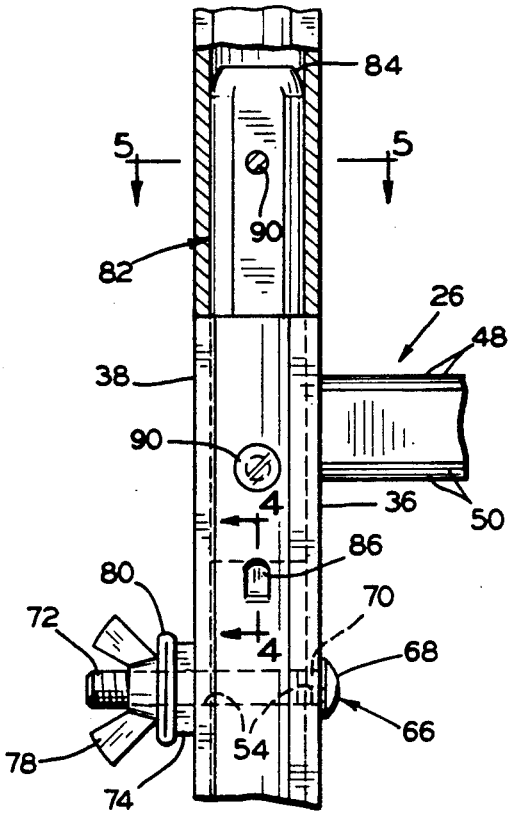
FIG. 3 is a fragmentary side view in elevation, with parts broken away, of two stacked end frames.

Each of the vertical frame members 24 has aligned square holes or openings 54 located in the thick portions 32 and 34 thereof. These are preferably spaced twelve inches apart and six inches from the ends of the vertical frame member. The square openings 54 are primarily used to receive bolts, and specifically carriage bolts, 66 which have heads 68, square shank portions 70, and threaded shanks 72 (FIG. 3). The square shank portions 70 fit closely with the square openings 54 to prevent turning. Retainer nuts 74 are threaded on the shanks 72 to retain the carriage bolts 66 firmly in place. An end 76 (FIG. 2) of a brace is then placed on the threaded shank 72 and a wing nut 78 tightened thereon to affix the brace to the inside of the vertical frame member 24. A brace end 80 can also be affixed to the outside of the vertical frame member 24, as shown in FIG. 3. Here the brace end 80 is affixed between the retainer nut 74 and the wing nut 78 near the narrow flat surface 38 of the vertical frame member 24. Thus, the carriage bolt and nut arrangement enables the brace to be connected to either side of the vertical frame member 24 with the retainer nut 78 firmly against the flat surface 36 or 38. In addition, if the threads should become damaged, the bolt can be readily replaced, which is not possible with the threaded studs heretofore employed which are welded to the end frames. The carriage bolts may be of the type having a nylon insert in the threaded end to securely hold the wing nut in place.

Figure 5:
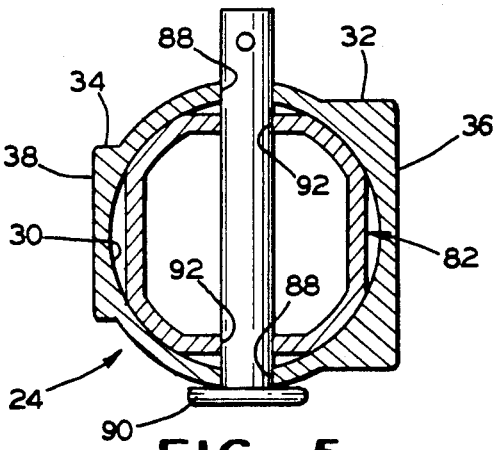
FIG. 5 is a view in transverse cross section taken along the line 5—5 of FIG. 3.
Figure 4:
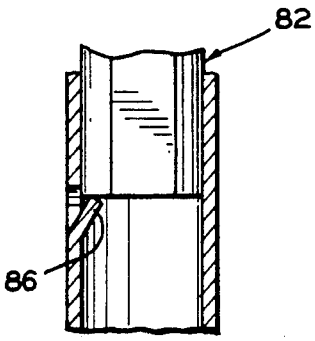
FIG. 4 is a fragmentary view in cross section taken along the line 4—4 of FIG. 3.

When the end frames 12 and 14 are stacked, the vertical frame members 24 are connected by connecting pins 82 (FIGS. 3–5). The connecting pins are substantially of uniform shape in cross section throughout their length except for a slightly tapered end 84 (FIG. 3). Without any collars at intermediate portions of the connecting pins, as heretofore have been employed, the pins are easier and less expensive to manufacture. As shown if FIG. 5, the connecting pin 82 is of generally square cross-sectional shape with rounded corners, with the maximum distance across diagonal corners of the pins being slightly less than the diameter of the cylindrical passage 30 in the vertical frame member 24. The particular shape of the connecting pin 82 enables stable contact between the pin and the vertical frame members yet reduces the friction therebetween, rendering the connecting pins easier to install and remove.

Upper portions of each of the vertical frame members 24 has a tab 86 (FIGS. 3–4) formed therein to engage the lower end of the connecting pin 82 and position it about halfway in the upper end of the lower vertical frame member and about halfway up the lower end of the upper vertical frame member, as shown in FIG. 3. Each of the rounded portions 28 of the frame members 24 also has aligned circular openings 88 which receive a suitable locking pin 90 (FIG. 5) which also extends through aligned holes 92 in the connecting pin 82. The locking pins 90 can be of several styles known in the art, being equipped with cotter pins or pivoted ends which prevent unwanted removal of the pins 90, for example.

Figure 6:
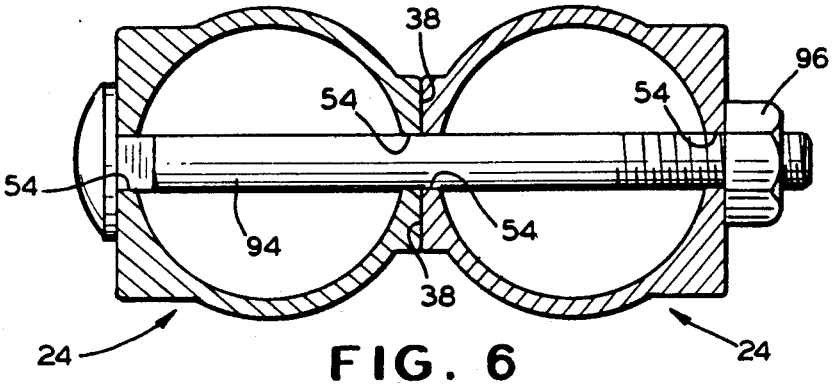
FIG. 6 is a view in transverse cross section taken through a vertical frame member of one end frame attached to a vertical frame member of another end frame.

As discussed the wide flat surface 36 provides a good weld base for the ends of the horizontal frame members 26. The surfaces 36 and 38 of the vertical frame members 24 provide flat surfaces to better secure the retainer nuts 74 on either side of the frame members. Also, when two of the end frames are fastened together in side-by-side relationship, as shown in FIG. 6, the flat surfaces 38 provide a stable contact between the adjacent vertical frame members 24. Here, a suitable long carriage bolt 94 extends completely through both of the vertical frame members and the various aligned square holes 54 therein, being secured by a suitable nut 96. The bolts 94 are spaced along the vertical frame members through the square holes as closely as needed.

Referring to FIG. 1, the base 22 has elongate base members 98 extending beyond the end frames 12 and 14 to provide a wider base for stacking the end frames higher, if desired. Casters 100 are located at the ends of the base members 98, as is known in the art. The base members are connected by cross braces 102 which can also be employed in place of the bracing 16, if desired. Ends of the braces 102 are connected to suitable threaded studs 104 on the base members 98. The vertical frame members 24 have the central passages 30 received over projections or stubs 106 extending upwardly from the base member 98. Upright struts 108 are affixed to the base member spaced slightly from the projections 106 and extend upwardly beyond the lower square holes 54 in the vertical members, with carriage bolts 110 extending through the square holes 54 and openings 112 in the struts 108 where they are secured by suitable nuts 114. This provides a stable yet relatively quick means to attach the end frames to the base.

From the above, it will be seen that the invention provides a lightweight scaffolding employing frame members of maximum strength with minimum material to reduce costs and further reduce weight. The invention also provides connecting pins which are easy to manufacture and provides brace connections which are versatile and replaceable. A base also is provided which can be relatively quickly and easily attached to and detached from the scaffolding.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. In a scaffold comprising end frames having upright frame members and horizontal frame members, the improvement comprising each of said upright frame members having a uniform cross section throughout most of its length and comprising a rounded portion having a central passage therethrough, a thicker first portion on one side of said rounded portion and having a first flat outer surface facing away from said rounded portion, and a thicker second portion on the opposite side of said rounded portion and having a second flat outer surface facing away from said rounded portion.

2. A scaffold according to claim 1 wherein said second flat outer surface is narrower than said first flat outer surface.

3. A scaffold according to claim 1 wherein said horizontal frame members have ends welded to said first flat surface.

4. A scaffold according to claim 1 wherein a second upright frame member is affixed to said first upright frame member with said second upright frame member having a second flat outer surface in contiguous relationship with said second flat outer surface of said second portion.

5. A scaffold according to claim 1 wherein said upright frame member has an inwardly-extending tab on one side of said rounded portion near an upper end of said upright frame member to support a connecting pin.

6. A scaffold according to claim 1 wherein said upright frame member has at least two openings along said thicker portions with the distance between said openings and the ends of said upright frame member being one half the distance between said openings.

7. A scaffold according to claim 6 wherein said openings are square.

8. A scaffold according to claim 1 wherein said upright frame member has at least three openings uniformly spaced along said thicker portions with the distance between said openings being twice the distance between the end openings and the ends of said upright frame member.

9. A scaffold according to claim 8 wherein said openings are square.

10. A scaffold according to claim 1 wherein a base is connected to the lower end of said upright frame member, said base having an upwardly-extending projection received in the lower end of said upright frame member and having a strut extending upwardly alongside said projection for fastening to said upright frame member above said projection.

11. A scaffold comprising a first end frame having two first upright frame members, a second end frame having two second upright frame members, connecting pins connecting upper ends of said first frame members with lower ends of said second frame members, said connecting pins being of substantially uniform cross section throughout most of their length, upper end portions of said first frame members having inwardly-extending tabs spaced from the upper ends thereof a distance substantially equal to one-half the length of said connecting pins, and locking pins extending through upper end portions of said first frame members and through said connecting pins, and through lower end portions of said second frame members and through said connecting pins, said vertical frame members being connected by horizontal frame members with the distance between adjacent intermediate horizontal frame members of each of said end frames equalling the distance between the uppermost horizontal frame member of said first end frame and the lowermost horizontal frame member of said second frame.

12. A scaffold according to claim 11 wherein each of said connecting pins has a generally square transverse cross section with rounded corners, each of said vertical frame members having a cylindrical passage, the diameter of said cylindrical passage slightly exceeding the maximum distance across diagonally opposite corners of said connecting pins.

13. A scaffold comprising an end frame having two upright frame members, a plurality of horizontal frame members between said upright frame members, each of said upright frame members having a uniform cross section throughout most of its length and comprising a rounded portion having a central passage therethrough, a thicker first portion on one side of said rounded portion and having a first flat outer surface facing away from said rounded portion, a thicker second portion on the opposite side of said rounded portion and having a second flat outer surface facing away from said rounded portion, each of said horizontal frame members being of ob-round configuration and having substantially parallel side walls and rounded upper and lower walls, with the maximum distance between said upper and lower rounded walls being greater than the distance between said side walls, said upper wall having means for providing surer footing thereon.

14. A scaffold according to claim 13 wherein ends of said horizontal frame members are affixed to said first flat outer surface of at least one of said upright frame members.

15. A scaffold according to claim 14 wherein said horizontal frame members are spaced uniformly from one another.

16. A scaffold according to claim 15 wherein the distance between the lowermost horizontal frame member and the lower ends of said upright frame members plus the distance between the uppermost horizontal frame member and the upper ends of said upright frame members equals the distance between adjacent horizontal frame members.

17. A scaffold according to claim 13 wherein said second flat outer surface is narrower than said first flat outer surface.

18. A scaffold according to claim 13 wherein said horizontal frame members have ends welded to said first flat surfaces of both of said upright frame members.

19. A scaffold according to claim 13 wherein each of said upright frame members has an inwardly-extending tab on one side of said rounded portion near an upper end of said upright frame member to support a connecting pin.

* * * * *